US007873514B2

(12) United States Patent
Ramprashad

(10) Patent No.: US 7,873,514 B2
(45) Date of Patent: Jan. 18, 2011

(54) METHOD FOR QUANTIZING SPEECH AND AUDIO THROUGH AN EFFICIENT PERCEPTUALLY RELEVANT SEARCH OF MULTIPLE QUANTIZATION PATTERNS

(75) Inventor: Sean A. Ramprashad, Los Altos, CA (US)

(73) Assignee: NTT DoCoMo, Inc., Tokyo (JP)

( * ) Notice: Subject to any disclaimer, the term of this patent is extended or adjusted under 35 U.S.C. 154(b) by 792 days.

(21) Appl. No.: 11/835,273

(22) Filed: Aug. 7, 2007

(65) Prior Publication Data

US 2008/0040107 A1 Feb. 14, 2008

Related U.S. Application Data

(60) Provisional application No. 60/837,164, filed on Aug. 11, 2006.

(51) Int. Cl.
*G10L 19/00* (2006.01)

(52) U.S. Cl. ..... 704/222; 704/200.1; 704/230

(58) Field of Classification Search ..... 704/200.1, 704/222, 230

See application file for complete search history.

(56) References Cited

U.S. PATENT DOCUMENTS 5,194,950 A * 3/1993 Murakami et al. ..... 375/240.16
5,210,820 A * 5/1993 Kenyon ..... 704/200
2006/0241940 A1 10/2006 Ramprashad

OTHER PUBLICATIONS

ITU-T, Coding of Speech at 8 Kbit-per-sec using Conjugate-Structure Algebraic-Code-Excited Linear-Prediction (CS-Acelp), ACELP, ITU-Recommendation G.729, Mar. 1996.
ITU-T, Recommendation G.722.1 (Sep. 1999), Coding at 24 and 32 kbit/s for Hands-Free Operation in Systems with Low Frame Loss, (ITU-T Recommendation G722.1), Sep. 1999, 26 Pages.
A. Gersho et al., Vector Quantization and Signal Compression., Kluwer Academic Publishers, Boston, 1972, 44 pages.
T. Berger, Optimum Quantizers and Permutation Codes, IEEE Transactions on Information Theory, IT-18, No. 6, pp. 759-765, Nov. 1972.
S. Ramprashad, Sparse Bit-Allocations Based on Partial Ordering Schemes With Application to Speech and Audio Coding, IEEE Transactions on Audio, Speech, and Language Processing, vol. 15, No. 1, Jan. 2007, 13 Pages.
S. Ramprashad, Efficient Quantization of Statistically Normalized Vectors Using Multi-Option Partial-Order Bit-Assignment Schemes, International Conference on Acoustics, Speech and Signal Processing, Toulouse, France, May 2006, 4 Pages.

(Continued)

*Primary Examiner*—Abul Azad
(74) *Attorney, Agent, or Firm*—Blakely, Sokoloff, Taylor & Zafman LLP

(57) ABSTRACT

A method and apparatus is disclosed herein for quantizing data using a perceptually relevant search of multiple quantization patterns. In one embodiment, the method comprises performing a perceptually relevant search of multiple quantization patterns in which one of a plurality of prototype patterns and its associated permutation are selected to quantize the target vector, each prototype pattern in the plurality of prototype patterns being capable of directing quantization across the vector; converting the one prototype pattern, the associated permutation and quantization information resulting from both to a plurality of bits by an encoder; and transferring the bits as part of a bit stream.

22 Claims, 9 Drawing Sheets

OTHER PUBLICATIONS

M.R. Schroeder et al., Optimizing Digital Speech Coders by Exploiting Masking Properties of the Human Ear, Journal of the Acoustical Soc. of Am., No. 6, vol. 66, pp. 1647-1652, Dec. 1979.

L.E. Humes et al., Models of the Additivity of Masking, Journal of the Acoustical Soc. of America, No. 3, vol. 85, pp. 1285-1294, Mar. 1989.

J.D. Johnston, Transform Coding of Audio Signals Using Perceptual Noise Criteria, IEEE Journal on Selected Areas in Communications, No. 2, vol. 6, pp. 314-323, Feb. 1998.

A. Spanias, Speech Coding: A Tutorial Review, Proceeding of the IEEE, vol. 82, No. 10, Oct. 1994, pp. 154-1582, Prolog, pp. 1539-1540.

T. Painter, Perceptual Coding of Digital Audio, Proceeding of the IEEE, vol. 88, No. 4, Apr. 2000, pp. 451-513.

S. Ramprashad, Partial-Order Bit-Allocation Schemes for Low Rate Quantization, Docomo Communication Labs, USA, 8 Pages.

PCT International Search Report, PCT/US2007/ 017719 mailed Feb. 20, 2008 (3 pages).

PCT Written Opinion, PCT/US2007/ 017719 mailed Feb. 20, 2008 (7 pages).

Ramprashad, S.A., "Efficient Quantization of Statistically Normalized Vectors using Multi-Option Partial-Order Bit-Assignment Schemes," Acoustics, Speech and Signal Processing, 2006. ICASSP 2006 Proceedings. 2006 IEEE International Conference on Toulouse, France May 14-19, 2006, Piscataway, NJ, USA, IEEE, May 14, 2006.

Ramo, A., "Improving LSF quantization performance with sorting," Signal Processing, 2004. Proceedings. ICSP '04. 2005 7$^{th}$ International Conference on Beijing, China Aug. 31-Sep. 4, 2004, Piscataway, NJ, USA, IREEE, Aug. 31, 2004.

Kvivek K Goyal et al., "On Optimal Permutation Codes," IEEE Transactions on Information Theory, IEEE Service Center, Piscataway, NJ, US vol. 47, No. 7, Nov. 2001.

Sean A Ramprashad Ed -Radna Krishna Ganti et al., "Partial-Order Bit-Allocation Schemes for Lowrate Quantization," Signals, Systems and Computers 2006, ACSSC '06, Fortieth Asilomar Conference on IEEE, PI, Oct. 2006.

Sean A. Ramprashad, "Sparse Bit-Allocations Based on Partial Ordering Schemes with Application to Speech and Audio Coding," IEEE Transactions on Audio, Speech, and Language Processing, IEEE Service Center, New York, U.S., vol. 15, No. 1, Jan. 2007.

* cited by examiner

METHOD FOR QUANTIZING SPEECH AND AUDIO THROUGH AN EFFICIENT PERCEPTUALLY RELEVANT SEARCH OF MULTIPLE QUANTIZATION PATTERNS

PRIORITY

The present patent application claims priority to and incorporates by reference the corresponding provisional patent application Ser. No. 60/837,164, titled, "A Method for Quantizing Speech and Audio Through an Efficient Perceptually Relevant Search of Multiple Quantization Patterns," filed on Aug. 11, 2006.

RELATED APPLICATIONS

This application is related to the co-pending U.S. patent application Ser. No. 11/408,125, entitled "Quantization of Speech and Audio Coding Parameters Using Partial Information on Atypical Subsequences," filed on Apr. 19, 2006, assigned to the corporate assignee of the present invention.

FIELD OF THE INVENTION

The present invention relates to the field of vector quantization; more particularly, the present invention relates to quantizing information such as, for example, speech and audio through a perceptually relevant search of multiple quantization patterns.

BACKGROUND OF THE INVENTION

Speech and audio coders typically encode signals using combinations of statistical redundancy removal, perceptual irrelevancy removal, and efficient quantization techniques. With this combination, the majority of advanced speech and audio encoders today operate at rates of less than 1 or 2 bits/input-sample. This often means that many parameters are quantized on average at very low rates below 1 to 2 bits/parameter. At such low rates, there can be challenges in particular in the quantization and irrelevancy removal steps.

The quantization step refers to the process of converting parameters that represent the speech or audio into one or more finite sequences of bits. A parameter can be quantized individually. For purposes herein, it is represented by a sequence of bits that contain no information on other parameters. If a parameter is represented by "s" bits, then there are at most $2^s$ alternatives one could consider for the representation. Such alternatives may be compiled in what is known as a "codebook". For single parameter quantization, the entries of the codebook are scalars that represent the different alternatives for representing the original parameter.

Parameters can also be quantized jointly whereby a sequence of bits refers to a group of two or more parameters. In such a case, codebook entries are multi-dimensional entries, with each being a representation of multiple parameters. One realization of this process is a "Vector Quantizer". Joint quantization often leads to more efficient quantization, though often there can be complexity penalties since now the number of bits "s" is larger given it is the sum of bits over all parameters.

The bits generated by quantization are sent to the decoder and are used to recover an approximation to the original speech/audio parameter(s). When the approximation to this parameter differs from the original parameter, the difference can be considered as noise added to the original parameter. This noise is the quantization noise referred to herein.

For audio and speech, such quantization noise may be perceived on playback as a distortion in the signal. This is because the decoded signal is in general different from the original signal because the quantized parameters are different from the original parameters.

Note, the signal parameters that are actually quantized can take many forms. Some of the most popular parameters used are frequency-domain samples/coefficients, e.g., as obtained by either a frequency-domain transform like a Modified Discrete Cosine Transform (MDCT) or filter-bank, and/or time-domain samples/coefficients. In such cases, the noise is perceived as distortion effects in different time and/or frequency regions.

The process of irrelevancy removal refers to the process whereby the noise is given a desired characteristic so that it is either not, or with minimal effect, perceptible on playback. For example, the noise may be at a low enough level that the human auditory system is not able to notice it during playback.

Note, in one realization of part of such an irrelevancy removal process, one can ignore some parameters entirely in the quantization process. This is the case in which zero bits are sent for the parameter(s). At the decoder, such a parameter is either ignored in the decoding process or set to some known fixed or random value. In all cases, there is quantization noise introduced into this parameter by ignoring such a parameter.

Irrelevancy removal can also be the process of directing and sending a sufficient approximation to the original parameter, i.e. deciding on and sending the correct number of bits, so that the noise is at a given desired level and thus the desired perceptual effect is achieved during playback.

The process of redundancy removal refers to the process of creating a parameter representation that allows for an efficient quantization of the signal. For example, the representation may facilitate an efficient distribution of bits to different parameters. For example, some representations concentrate the original signal energy into as few parameters as possible. Representations such as the MDCT have such a property when applied to many audio and speech signals. This allows bit resources to be concentrated into a few parameters with other less important parameters receiving less or no bits.

This MDCT representation (and similar types of frequency domain representations) also has an added benefit because it represents the frequency content in the audio signal. Perceptual distortion as a function of frequency content is a subject studied in great detail. Therefore, such representations are also useful for irrelevancy removal.

In designing a good audio/speech coder, there are strong inter-dependencies in the relative effectiveness of the quantization, redundancy removal and irrelevancy removal processes. For example, in selecting a quantization option (if there are many to choose from) one may try to predict what type or level of noise the quantization process may generate. For example the expected (average) noise each quantization option will introduce could be used to predict the potential perceptual effect each of the options may have. This can lead to a process whereby coding (quantization) decisions/options are selected up-front, before the quantization step, in a signal adaptive manner based on average expectations.

Decisions generally can be made up-front if one expects the quantization process to have a good or generally "well behaved" predictable outcome. For example, a designer may know ahead of time that the encoder has enough bits to quantize the signal sufficiently well so that the quantized signal will have, or often have, a very low, if not imperceptible, amount of quantization noise. Such a well-behaved scenario may be, for example, the situation of quantizing a signal at a sufficiently high bit rate. It may be a scenario where the audio signal is such that it can be represented with a small number of parameters. In such cases, the processes of quantization, redundancy removal and irrelevancy removal can work semi-independently knowing that each is able to reach their respective desired outcomes.

For example, in such a scenario, the irrelevancy removal process may direct the quantization process using a pre-calculated perceptually relevant "noise threshold". Some audio coders calculate, before the parameter quantization step, a "perceptual noise threshold" (set of upper-bound values) that quantization noise must adhere to for each parameter, e.g. each MDCT coefficient must not have noise exceeding its respective threshold. This threshold (often a vector of values) specifies for each parameter the desired limit on the quantization noise for the parameter. Knowing ahead of time that such a threshold is often achievable makes such an approach feasible.

One refinement to this process involves minor modifications to this threshold if by chance the encoding does not successfully attain the threshold for any parameter. Take for example the case where a group of parameters has to achieve a noise threshold (upper-bound) of "Delta", and the coder only has "b" bits to do so. One such process is illustrated in FIG. 1A. If one uses a uniform scalar quantizer with step size "Delta," the quantization step assigns for each parameter an integer that specifies how may "Delta" steps it takes to give a good approximation of the value. For example, if a parameter has value −1.33, and Delta is 0.50, one could specify that it will take negative three "Delta" steps to approximate the signal. Here the representation of the original parameter is −1.5, and the noise level is the absolute value of difference between −1.50 and −1.33, i.e. 0.17, which is less than Delta.

In the example mentioned above, the numerical index to which the original parameter is mapped to is −3. This number is then mapped to a sequence of bits. In this case, one can either map indices to a fixed number of bits, e.g. 3 bits would be sufficient to represent 8 unique integer values such as −3, −2, −1, 0, 1, 2, 3, 4. Or a variable number of bits could be used, exploiting the fact that some integer values are used more frequently, e.g. as done in Huffman coding, where each variable bit representation can be uniquely parsed from the stream. Such techniques are known widely by those skilled in the art of audio coding and are in fact used frequently in audio coder designs.

However, the main issue is that often the number of bits needed to ensure the noise on each parameter is less than "Delta" is often not known until all the parameters are coded. Often, the number of bits used can be variable if variable length coding techniques such as Huffman coding are used. It can be that at the end of quantization with respect to "Delta" the number of bits exceeds the maximum "b" the encoder has for the process.

To solve this problem at times one can make a slight modification to the threshold (e.g., increase the acceptable noise level by a factor), and re-code. Referring to FIG. 1A, an audio coder may test different levels "Delta", in particular an increasing sequence of Delta values, to find a value that achieves an acceptable total number of bits "n(1)+n(2)+ . . . +n(N)". In general, a larger "Delta" requires a fewer total number of bits. This classic iterative process often is termed a "rate-loop" in some audio coder designs. It makes sense only if such slight modifications to the original threshold also result in a meaningful new (easier to attain) perceptual threshold.

However, as mentioned, such processes may be only attractive when the coding steps, in particular quantization, are well-behaved. At very low bit-rates, accurately predicting the exact joint behavior of the three processes ahead of time, in particular the joint behavior of the irrelevancy removal and quantization steps, may be difficult. One reason for this is the potentially very high levels (and randomness) of the noise introduced by the quantization process at low rates. If, indeed, the actual quantization noise introduced is both very random and at a high level for a given quantization option, an accurate assessment of the true perceptual effect of a quantization option may not be possible until after quantization. In particular, the perceptual assessment has to be done considering noise that varies in level from parameter to parameter above the threshold. In fact, in such cases, simple modifications to an original target perceptual threshold, such as increasing "Delta", may not make sense. Specifically, there may be no single target perceptual threshold or set of thresholds that one could easily pre-determine to be relevant to the final quantization outcome. It means that some classical approaches of selecting options apriori based on expectations (average behavior) and predictions may not be efficient. The dependence and complications of perception are discussed in more detail below.

As mentioned above, the processes of statistical redundancy removal, irrelevancy removal and quantization are quite inter-dependent. It should be mentioned that it is not necessarily easy to fix this issue by simply improving the redundancy removal step. For example, if the redundancy removal step is very efficient it often means that most of the signal representation is distilled into a few parameters. For example, most of the energy of the original "N" speech/audio signal parameters is now concentrated mainly into "T" new signal parameters by this step (where T is much less than N). When this happens, it helps the quantization and irrelevancy removal steps, but at low rates, often one cannot quantize all the new "T" parameters to a very high fidelity. While one can consider multiple redundancy removal options, in the end the joint operation of irrelevancy removal and quantization is very important at low rates.

Perceptual principles guide the irrelevancy removal step and thus quantization. With such principles, a prediction as to how noise will be perceived for each parameter, or jointly across many parameters, may be made. One realization of such a process is the "absolute perceptual threshold" which is very relevant to the approach mentioned previously. In this case, in low noise levels, one may simply have to calculate a threshold that reflects decisions as to whether or not the human auditory system can perceive noise above/below such selected level(s). This level(s) is signal adaptive. In such a case, the perceptual threshold specifies a set of quantization noise levels for parameters below which noise is not perceived, or is perceived at a very low acceptable level. Since level for each parameter represents the point of making a binary decision, it simplifies greatly the computation. Quantization is simplified since it only has to ensure the levels are not violated, or violated only infrequently, to result in a desirable encoding of the speech or audio signal. However doing calculations to generate such a "absolute perceptual threshold" for even such assumed low targeted noise levels can already be very computationally intensive.

Calculating the perceptual effect for higher levels of noise, noise that will violate strongly the "absolute perceptual threshold" for one or more parameters, is more complex since not only does one have to make a determination if the noise is perceived, but also how and/or to what level it is perceived. This situation is the situation of "Supra-Threshold" noise, i.e. noise above the threshold of perception. In this case, the exact levels of noise achieved for each parameter are important beyond simply their relation to the absolute threshold. Also, supra-threshold noise on one parameter often interacts perceptually with noise from a different parameter, in particular if the noise they introduce is sufficiently close in time and/or frequency. Thus one cannot often determine accurately the perceptual effect of Supra-Threshold noise until after quantization. It implies that when operating in the "Supra-Threshold" region parameters cannot be independently quantized, e.g. quantized in a manner such as testing each relative to its own "threshold".

With a coder in which quantization noise conforms to an "absolute perceptual thresholds," a coder can calculate a perceptual threshold or target set of levels in the irrelevancy removal step before the quantization process. The threshold is then used as a target for the quantization process without knowing ahead of time what the quantization process will achieve. This is a realization of what is known as an "Open Loop" process. Thus, this process has the advantage that some decisions are made up-front (given the mathematical complexity) and never revisited, or are only modified in simplistic ways such as raising a threshold. For purposes herein, this is referred to as an "Open Loop Perceptual Process" to distinguish from other processes that can also be Open Loop.

However at low bit-rates, as mentioned before, it can be difficult or impossible to accurately predict ahead of the quantization process the exact joint performance of the irrelevancy removal and quantization steps. The "Open Loop Perceptual" process is less attractive in this scenario. This is because the noise is now perceptible, i.e. supra-threshold as mentioned previously, and the quantization process can behave in very random ways, and good quantization by nature has to be a joint encoding of parameters. In this case, the exact level, or an accurate estimate of the level, of the quantization noise often needs to be known before a perceptual determination of performance can be made. The difficulty is compounded by the inherently high levels and variability of the noise introduced by the quantization process at low bit-rates. Given this, any prior estimate of the introduced noise may be of little use since the estimate may often be inaccurate.

Note that if estimates of expected levels are not possible, one could also use the worst-case value, which can lead to over-conservative decisions and further inefficiencies.

To solve this problem, a "Closed Loop" processes is used. In this case, multiple assumptions are made and/or multiple quantization options are performed, and each assessed perceptually after the quantization step where it is known what quantization noise results from each option.

In this case, in a "Closed Loop Perceptual Process," one could test all quantization options, calculating the exact noise each option produces, and then select the one with the best perceptual advantage. Some coders to do just that. For example, one could use a number of different heuristics to modify an underlying perceptual threshold and/or use a number of different quantization representations and hope that one produces a combination where the quantization step achieves the target threshold.

In fact, at the extreme, for a given number of bits "b" allocated to a group of parameters, there are potentially up to "$2^b$" threshold and/or quantization options one could consider, each possibly with a very random and un-predictable noise pattern, and thus perceptual effect, for a given signal. However, for computational complexity reasons, testing all quantization options and their actual perceptual effects is often not practical.

For example, quantizing 40 parameters at 1 bit/parameter means there can be up to $2^{40}$ options. Consider that audio coders are often quantizing many thousands of parameters a second, and for each option, in the extreme, a perceptual assessment may have to be done on all groups since all have high "Supra-Threshold" noise levels.

Because of these reasons, a "Closed Loop Perceptual Process" design by nature cannot be an exhaustive search on "$2^b$" independent alternatives One way to use a Closed Loop process is to greatly simplify the complex supra-threshold model. One way to do this is to replace the supra-threshold model by simple approximate criteria. One such type of criteria used often is signal adaptive weighted mean square error (WMSE) distortion criteria. This is what is done in many speech coding designs, e.g. the Algebraic Code Excited Linear Prediction (ACELP) designs used in ITU-T Rec. G729 and other ITU-T and ESTI standards. With simplified MSE-like criteria coders can use classic MSE-based procedures for searching classical vector quantization codebooks. Such codebooks, like "Algebraic Structured" codebooks, or "Tree", "Product" or "Multi-Stage" vector quantizers, are designed to be able to search "$2^b$" alternatives efficiently by discarding a large fraction of the $2^b$ alternatives in the search process.

In this case, however, many vector quantization structures often do not make very explicit links to how noise may be allocated to different parameters. It is often a blind design relying on the WMSE criteria to help sort out the possibilities. So while the complexity of the search process can be reduced by structure in the codebook design effectively a non-trivial fraction of the "$2^b$" alternatives have to be tested. For example, in a two-stage codebook design with b/2 bits at each stage, one still has to consider on the order of $2^{b/2}+2^{b/2}$ alternatives. That is, without explicit control of noise within the codebook design, to ensure efficient quantization, one needs to ensure sufficient numbers of alternatives are considered and searched. This necessitates the use of a simplified perceptual criteria, such as Mean Square Error based measures, to enable this search, and much work in the field is spent on coming up with designs that do a search efficiently yet still perform well, even with a WMSE criterion. Designs that perform well with more accurate and complex criteria often are not, and cannot, be considered.

It should also be noted that when coders use a weighted mean square error (WMSE) measure the measure implicitly assumes that the actual noise, in the end of the search, is distributed as the weighting directs, with areas weighted more heavily hopefully directed to having less noise. However, in practice, the exact level of the noise for different parameters may or may not follow the general trend that is hoped for by the weighting, in particular at low rates.

See the example in FIG. 1B. The weighted measure, and the design of the codebook for such a measure, simplifies and hides the precise effect of individual noise levels through the use of a summation (within the MSE criteria) that expects the noise to approximately behave as desired.

The number of search possibilities has been reduced in at least one prior art implementation which will be discussed later. In contrast, the codebook structure in ACELP and other classic vector quantizer designs can not be used with complex perceptual criteria even though its structure allows for searches that effectively reduce the number of alternatives to less than $2^b$. By nature, the search only works efficiently when coupled directly with MSE-like criteria. An example of an ACELP-based search mechanism that operates used in ITU-T Rec. G.729 whereby 40 residual time samples are jointly quantized with a signal adaptive WMSE criterion.

It is also important to re-iterate that most "rate loop" searches within audio coders deal with the issue of bitrate, and only weakly with optimizing perceptual performance since an "absolute perceptual threshold" is modified necessarily by simple means in the rate look. Here the rate-loop does have a "Closed Loop" element, but by nature the search is more about rate-distortion optimization than carefully optimizing the resulting supra-threshold perceptual effects of the now perceptible quantization noise. Such effects can only be accurately predicted after the exact noise levels are known and are not simply assessed by checking noise levels against thresholds.

In short, both classical approaches above in speech and audio coding can have:

a) inherent inefficiencies as they simplify the distortion metric, and/or e.g., using a WMSE though true perception is more complex
b) overly conservative constraints limiting options e.g., imposing a maximum uniform level within a scale-factor band, and/or
c) overly conservative assumptions on the noise levels and/or e.g., using the maximum level rather than the actual or "closer to actual" mean level
d) errors between their intended and actual noise allocations, e.g.,
   a. errors are not distributed with shapes/characteristics one may assume by a using WMSE criterion,
   b. errors may in fact vary so much that expected or predicted levels may have very little use.
e) very little explicit control of the noise level assigned to individual parameters when jointly coding multiple parameters by vector quantization or structured codebook representations.

This can happen especially when operating at low bit rates. As a result, there are inefficiencies when coders attempt to link perceptual performance with predictions, or use simplistic assumptions when directing quantization.

Recently, there is a class of new quantization options, termed partial-order quantization schemes which have the property of being able to create purposefully non-trivial patterns of bits allocations (and thus estimated noise allocations) across a vector of parameters.

For a "b"-bit quantization scheme, a proto-type pattern "P" is used to generate $2^c \ll 2^b$ possible patterns, all related by a limited permutation of the proto-type pattern, much like a permutation code, though, in this case, one permuting bit-assignments not elements of codewords as the classic "Permutation Codes". For example, a pattern "P"

P=p(1),p(2), . . . ,p(N)

has elements "p(j)" that each define how a particular parameter from the "N" total parameters is to be quantized. One may often consider only a subset of such permutations, e.g. maybe just two such permutations as:

p(2),p(1),p(3),p(4),p(5), . . . ,p(N) and p(3),p(1),p(2),p(4), p(5), . . . ,p(N)

One motivation for limitation of the permutations (partial ordering) comes from the fact that often p(j)=p(i) for some i and j, thus making some permutations equivalent. For example, in the above, if p(1)=p(2)=p(3), then the two above patterns are the same and would not be distinguished as different permutations.

More generally, one can limit the permutations for other reasons, e.g. permutations that, for instance, concentrate (or spread) higher values p(j) in the new pattern (permutation). In the case that "p(j)" is a bit-allocation, it has been shown, in fact, that at low bitrates using such non-trivial patterns can be more efficient than other quantization techniques that either create equal patterns of bit allocations (where p(i)=p(j) for all i,j).

Such equal patterns of bit allocations can equivalent to equal patterns of estimated noise allocation. For example, if p(i)'s are noise allocations, then p(i)=p(j)="Delta" is an assignment that creates a target similar to that in FIG. 1. In all cases the number of unique permutations, $2^c$, considered is less than (often much less than) N!

If the patterns are bit-allocations, and the quantization process of each parameter is constrained to use the given number of allocated bits for a parameter, then the total number of bits used by the allocation is known ahead of time, i.e. the pattern uses p(1)+p(2)+ . . . +p(N) bits. Therefore, there is no uncertainty in the number of "Deltas" used, and thus bits spent, as in the process in FIG. 1A.

The procedure also has simplifications in searching for good permutations. One way to do implement the quantization procedure is not to permute the bit (or noise) allocation but to permute to a target vector X=x(1), x(2), . . . , x(N), keeping the quantization pattern P=p(1), p(2), . . . , p(N) fixed. The term "partial order" arises from the fact that it is often good to permute the x(j)'s by partially ordering the x(j)'s in terms of energy of perceptual relevance.

It has been also shown that if one considers multiple prototype patterns, e.g. $g=2^d$ patterns P(1), P(2), . . . , P(g), where with pattern P(k) generating itself $2^{c(k)}$ patterns related by a partial order (limited permutation), performance can be further improved. For example, Pattern 1: P(1)=p(1,1), p(2,2), . . . ,p(N, 1)
Pattern 2: P(2)=p(1,2), p(2,2), . . . , p(N,2)
. . .
Pattern g: P(g)=p(1,g),p (2,g), . . . , p(N,g), where p(i,j) (like the p(i) in the previous example) is a value specifying how to quantize a parameter. To ensure that "b" bits was spent on quantization, then d+c(k)+p(1,k)+p(2,k)+ . . . +p(N,k)=b for all patterns k=1, 2, . . . ,g Furthermore, for a given pattern P(k), one can identify with little computation (or very little beyond an absolute perceptual threshold calculation) which of the $2^{c(k)}$ patterns has the best perceptual advantage.

SUMMARY OF THE INVENTION

A method and apparatus is disclosed herein for quantizing data using a perceptually relevant search of multiple quantization patterns. In one embodiment, the method comprises performing a perceptually relevant search of multiple quantization patterns in which one of a plurality of prototype patterns and its associated permutation are selected to quantize the target vector, each prototype pattern in the plurality of prototype patterns being capable of directing quantization across the vector; converting the one prototype pattern, the associated permutation and quantization information resulting from both to a plurality of bits by an encoder; and transferring the bits as part of a bit stream.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1A:
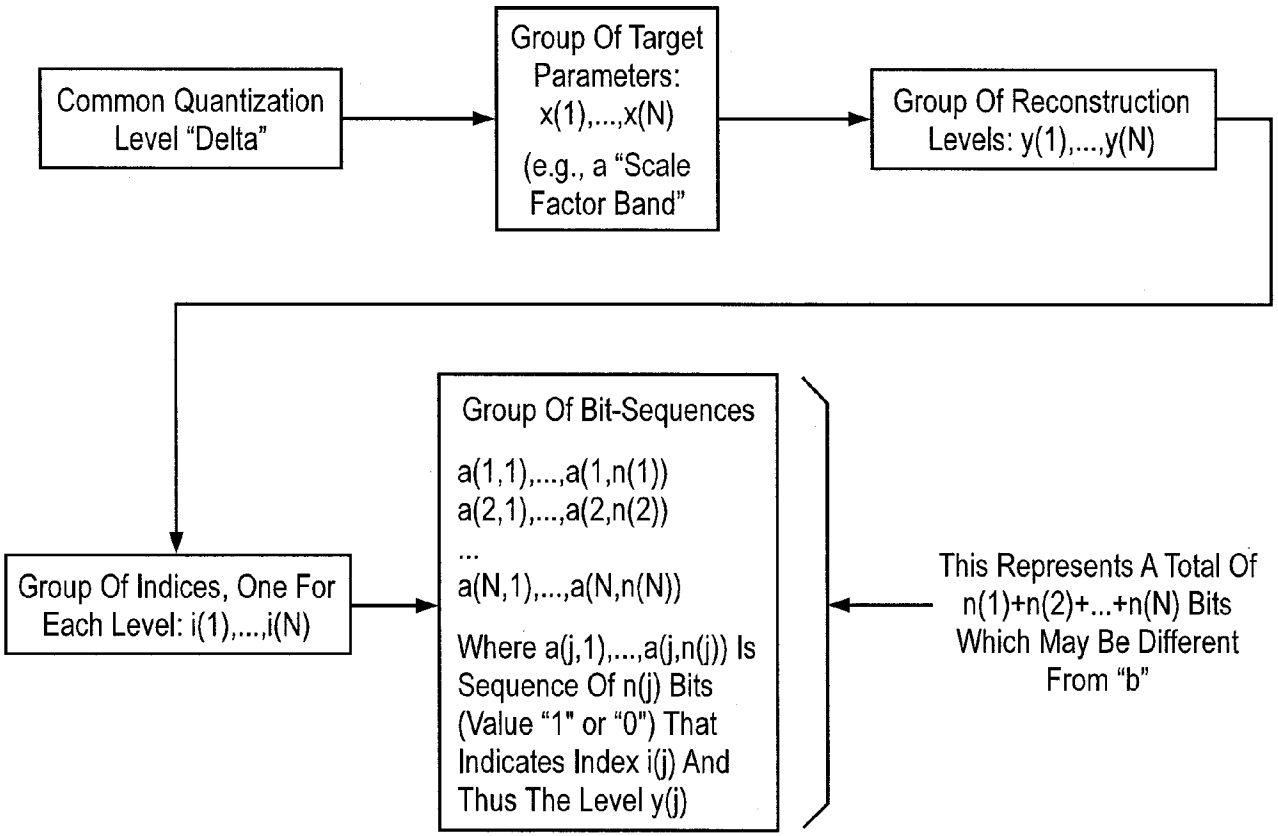
FIG. 1A illustrates a quantization example with a uniform level.
Figure 1B:
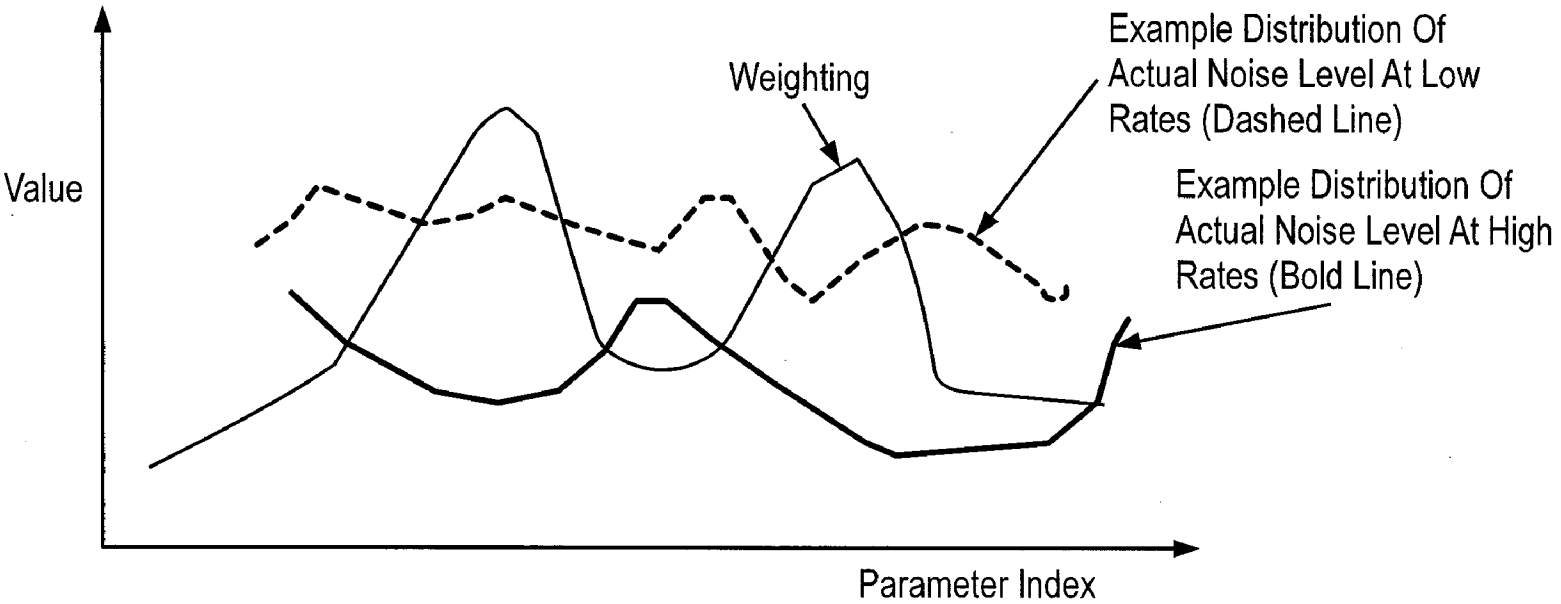
FIG. 1B illustrates an example of a weighting function and possible outcomes at low and high bit rates.

A technique for quantizing data using a perceptually relevant search of multiple quantization patterns is described. In one embodiment, a limited, though efficient, subset of quantization options (e.g., $2^a$ options, where $2^a$ is much less than the total maximum of $2^b$ possible non-trivial options for quantizing a group of parameters using "b" bits).

In one embodiment, a combination of a multi-option method (which limits the subset of options in a perceptually relevant way, and carefully makes sure such options are different enough to be worth searching) with a measure that predicts perceptual effects of each noise-allocation pattern (either actual or assumed) is used. In this manner, one can achieve a joint method that in an efficient, flexible and effective manner is able to better search and select quantization options based on known tested quantization noise and perceptual effects, while enabling one to consider more advanced perceptual criteria (distortion models) since it reduces computation by making good subset selections of options up-front thus limiting actual testing to a few good options.

In one embodiment of the present invention, a Closed Loop Perceptual Process is used that has a codebook structure which allows fast (limited) Closed-Loop Searches, and has a structure directly related to perceptual considerations, and allows one to chose multiple options with different perceptual effect.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

Overview

As is described below, a technique is disclosed that allows one to efficiently identify and test many noise-allocation patterns for their perceptual (masking) effects using an underlying quantization scheme which itself considers many noise-allocation patterns. In this manner, searching for the quantization option with the best actual perceptual advantage can be achieved by a fast (partial open-loop in nature) search of each prototype pattern, and then taking the selection for each pattern and calculating the actual quantization noise for only a small number "m", $M=g\leqq m<2^b$, of non-trivial patterns of noise using a closed-loop process. The value "m" is often much less than $2^b$. In one embodiment, m=g, but it can be, without loss in generality, that more permutations are considered. For example if two proto-type patterns are actually the same, which has the resulting effect that two-permutations of a single pattern may be considered. It can also be that one considers more than one permutation for a given unique prototype pattern based on two possible orderings of the target vector. The ability to limit the number of patterns, and thus the number of Closed-Loop tests, allows one to use complex perceptual criteria in making the final decision. Such criteria are more accurate in predicting "Supra-Threshold" effects of quantization noise.

In one embodiment, a permutation (partial-order) coding scheme is used and to (loosely or exactly) match a bit-pattern to a set of parameters in such a way that (at least on average) higher energy components receive the larger bit-allocations.

Thus, a novel combination of a multi-option, limited permutation/partial order, quantization scheme with a perceptual criterion which leads to an efficient (limited) combined open loop with a limited closed loop perceptual process of quantization. In one embodiment, the combination is implemented with three main components, namely a set of M proto-type bit-allocation patterns, a fast search perceptually relevant search method, and a perceptual measure used for making a decision, that operate together in a novel fashion. These three components operate to test all prototype patterns and select a pattern (e.g., the best pattern) to use for quantizing a target vector.

Figure 2:
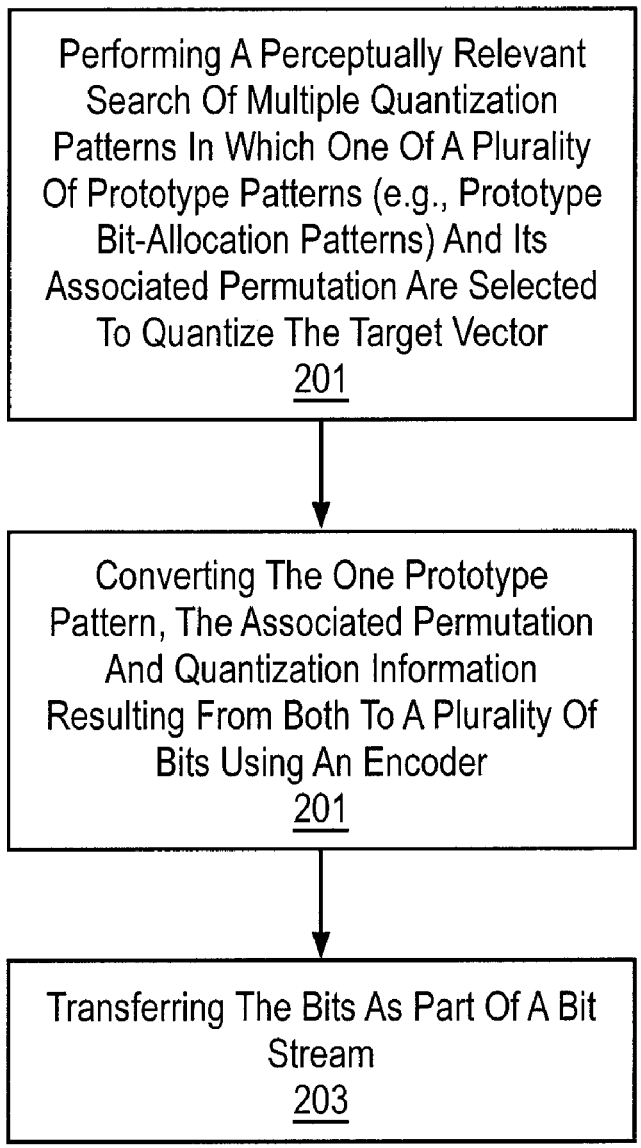
FIG. 2 is a flow diagram of one embodiment of a process for quantizing a target vector.

FIG. 2 is a flow diagram of one embodiment of a process for quantizing a target vector. The process is performed by processing logic that may comprise hardware (circuitry, dedicated logic, etc.), software (such as is run on a general purpose computer system or a dedicated machine), or a combination of both.

Referring to FIG. 2, the process begins by processing logic performing a perceptually relevant search of multiple quantization patterns in which one of a plurality of prototype patterns (e.g., prototype bit-allocation patterns) and its associated permutation are selected to quantize the target vector (processing block 201). In one embodiment, each prototype pattern in the prototype patterns is capable of directing quantization across the vector.

In one embodiment, performing the perceptually relevant search of multiple quantization patterns comprises selecting permutations of the prototype patterns and selecting one of the prototype patterns and its associated permutation by searching the selected permutations using a distortion criterion. In one embodiment, selecting the permutations of a plurality of prototype patterns is performed in an open loop manner. In one embodiment, selecting the permutations of the prototype patterns is performed implicitly by re-ordering elements of the target vector into an ordering without reordering elements in each prototype pattern. In one embodiment, the elements of the target vector are re-ordered based on energy into an ordering that is selected from a group consisting of a complete ordering and a loose ordering. The ordering may be partial or complete. In one embodiment, the elements of the target vector are re-ordered based on perceptual relevance into an ordering that is selected from a group consisting of a complete ordering and a loose ordering. The ordering may be partial or complete.

In one embodiment, the one prototype pattern specifies a number of bits to be allocated to each element in the target vector during quantization. In another embodiment, the one prototype pattern defines quantization step sizes to be allocated to each element in a vector during quantization. In yet another embodiment, the one prototype pattern specifies a local dimension of a quantizer to perform the quantization. In one embodiment, the local dimension indicates a number of elements in the target vector to be jointly quantized. In one embodiment, each of the prototype quantization patterns has repeated elements that define equivalent quantization options.

After performing the perceptually relevant search, processing logic converts the one prototype pattern, the associated permutation and quantization information resulting from both to a plurality of bits using an encoder (processing block 202).

After the encoding operation, processing logic transfers the bits as part of a bit stream (processing block 203). In one embodiment, transferring the bits as part of a bit stream comprises transferring the bit stream to a decoder. In another embodiment, transferring the bits as part of a bit stream comprises storing the bit stream in a memory.

Figure 3:
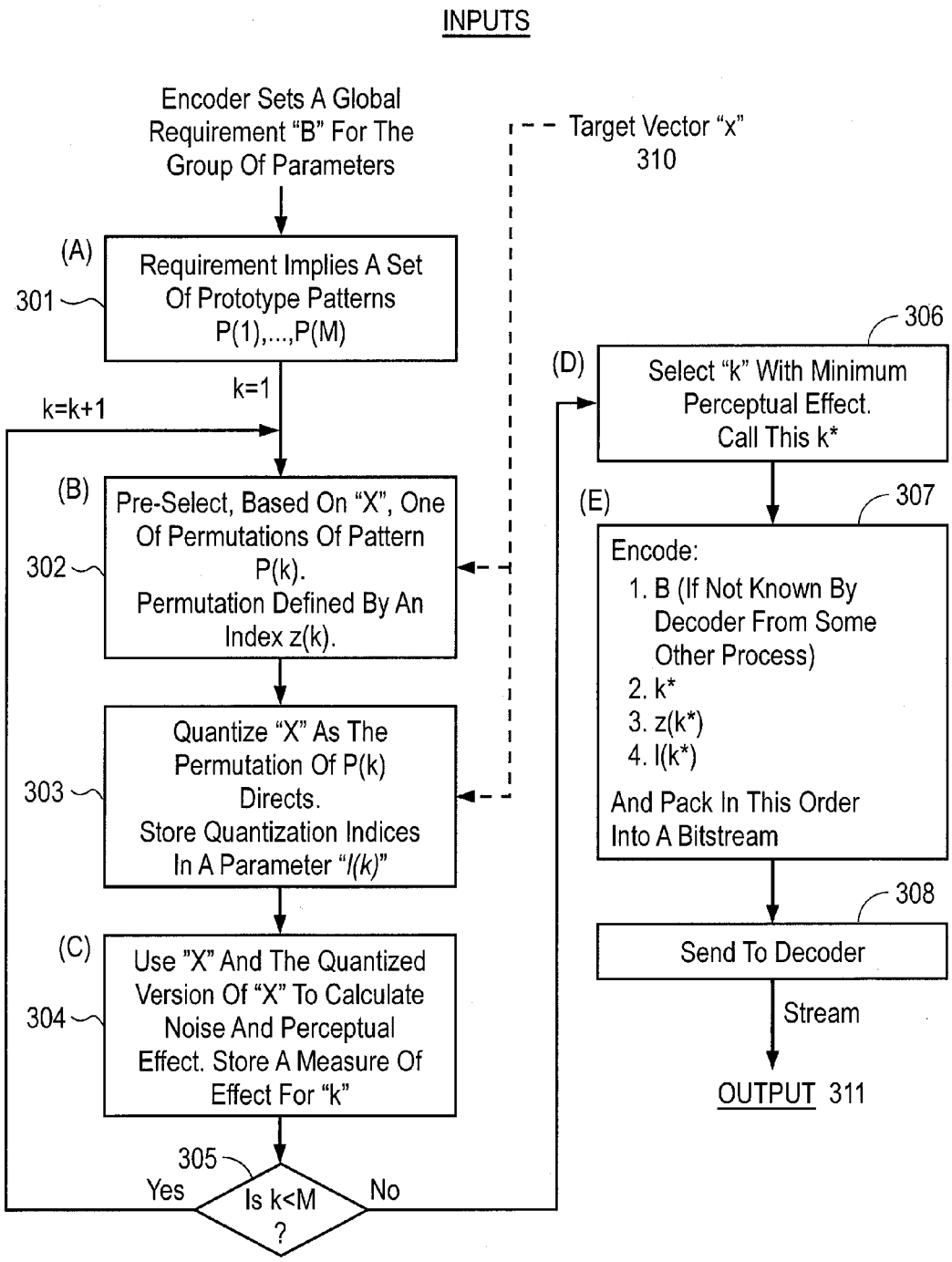
FIG. 3 is a flow diagram of one embodiment of an encoding process.

FIG. 3 is a flow diagram of one embodiment of an encoding process. The process is performed by processing logic that may comprise hardware (circuitry, dedicated logic, etc.), software (such as is run on a general purpose computer system or a dedicated machine), or a combination of both. The processing logic may be part of an encoder.

Referring to FIG. 3, prior to the encoding process beginning, the encoder sets a global requirement B for the group of parameters. B may be any global requirement. In one embodiment, B is a global bit-rate requirement.

The global requirement B implies a set of proto-type patterns P(1), . . . , P(M) (processing block 301) that conform to this requirement. This set can be calculated offline beforehand in the coder design stage for each B. In one embodiment, the patterns are known to the encoder and decoder.

These patterns P(1), . . . , P(M) direct the quantization of the target vector X=x(1), x(2), . . . , x(N). In one embodiment, the patterns are a set of proto-type noise-level patterns. In another embodiment, these patterns are a set of patterns of any parameter that defines a quantization method or resolution of a quantization method. For example, the patterns can be in bits, which specifies the size of the codebook and the number of bits needed to encode the quantization index with a fixed-rate code; the patterns can be a step size that defines a regular quantizer such as, for example, a uniform scalar quantizer; or the patterns can be a parameter that specifies the (relevant properties and thus) codebook used for the quantizer. In one embodiment, the key is that the set of proto-type bit-allocation patterns is a set of non-trivial (specifically non-uniform) patterns, and it can be arranged (permuted) in a perceptually meaningful way.

If quantizing N parameters, X=x(1), x(2), . . . , x(N), then a prototype pattern P(k) can be a sequence of N quantization options for "N" speech/audio parameters. In one embodiment, P(k)=f(1,k),f(2,k), . . . ,f(N,k), where the parameter f(i,j) is the value that specifies the quantization method or resolution of the quantization method, e.g. as described above. The prototype pattern may be a sequence of less than N parameters if a value f(i,j) is to be used for more than one parameter (e.g., in variable dimension coding).

A permutation of P(k) is defined and implemented in two possible methods by a permutation of the integers 1, 2, . . . , N. This permutation of such integers is a sequence of unique indices i(1),i(2), . . . ,i(N) where for all w,v=1, . . . ,N: $1 \leqq i(w) \leqq N$ and $i(w) \neq i(v)$ if $w \neq v$. In one embodiment, this permutation takes the prototype patterns and maps it to another pattern P2(k)=f(i(1),k), f(i(2),k), . . . , f(i(N),k). In this case, f(i(j),k) is used to direct the quantization of parameter x(j). In another embodiment, this permutation takes the vector X and permutes it to Xnew=[x(i(1)), x(i(2)), . . . , x(i(N))]. In this case, f(j,k) is used to direct the quantization of x(i(j)).

Note, there is a pair of permutations (one defined by the "inverse" permutation of the other) that makes both processes equivalent.

In one embodiment, the proto-type pattern P(k) allows for up to Q(k) possible permutations. If quantizing N parameters, there can be at most N! permutations. However, if the pattern has repeated values (e.g., P(k)=[1,1,2,2,2,3,4,4, . . . ]), there are Q(k) less than N! unique patterns. In one embodiment, the permutations are limited using other criteria as mentioned above.

In one embodiment, there are multiple sets of such parameters (e.g., multiple sets of proto-type patterns) that are cover different scale-factor bands, bitrates, etc. In one embodiment, the set of patterns is selected, for example, by a global bit-rate requirement B.

Referring back to FIG. 3, with the global requirement B set, processing logic initializes a variable k to 1 and the process begins with processing logic pre-selecting, based on X, one of the permutations of pattern P(k) (processing block 302). In one embodiment, a fast search perceptually relevant search method is used to select one (or a small number) of permutations of a prototype pattern. In one embodiment, this is performed, as described above, by a loose or complete ordering of X using energy. In one embodiment, the permutation is defined by an index z(k).

Processing logic then quantizes X as the permutation of P(k) directs (processing block 303). In one embodiment, processing logic also stores the quantization indices in a parameter I(k).

Processing logic uses X and the quantized version of X to calculate noise and perceptual effects for the permutation (processing block 304). In one embodiment, processing logic uses a perceptual measure for making a decision. In one embodiment, the perceptual measure is a signal adaptive function comprised of multiple components such as, for example, but not limited to: masking level calculations; a function to map energy and other measures to perceptual loudness, spreading of energies, etc. In one embodiment, processing logic stores a measure indicative of the effect for the variable k.

Thereafter, processing logic tests whether k<M, the number of patterns (processing block 305). If it is, processing logic increments k by one and transitions to processing block 302 where the process continues and repeats. If not, processing logic transitions to processing block 306.

At processing block 306, processing logic selects the k with the minimum perceptual effect. For purposes herein, this is referred to as k*.

Once k* has been selected, processing logic encodes B (if not known by the decoder from some other process), k*, index z(k*) that defines the permutation, and the parameter I(k*) that stores the quantization indices and packs them in this order into a bitstream (processing block 307), although other orders may be used as long as the decoder is aware of the order.

In one embodiment, the total number of bits used for quantizing a group of parameters may or may not conform to a total bit or noise-level constraint. For example, in one embodiment, if the system has a hard constraint of B bits for a given set of patterns, then when quantization is using bit-allocation patterns, the following constraint can be used:

$$\text{Roundup}(\log 2[m])+\text{Roundup}(\log 2[Q(k)])+\text{sum of bits in prototype pattern } k=B.$$

This would be a sufficient number of bits to specify k*, z(k*) and I(k*).

That is, during encoding the proto-type pattern P(k*) that is ultimately selected is indicated to the decoder using an encoding parameter. In one embodiment, it is encoded into a binary string using Roundup(log 2(m)) bits. This would be one way to encode the parameter k* in FIG. 3. Also, the permutation z(k) that is selected can be specified with a binary string of no more than Roundup(log 2[Q(k)]) bits. In one embodiment, the parameters k*, z(k*) and I(k*) are jointly coded rather than separately encoded as above.

Once packed into the bitstream, processing logic sends the bitstream as output 311 (processing block 308). In one embodiment, the bitstream is sent to memory. In another embodiment, the bitstream is sent to a decoder for subsequent decoding.

Figure 4:
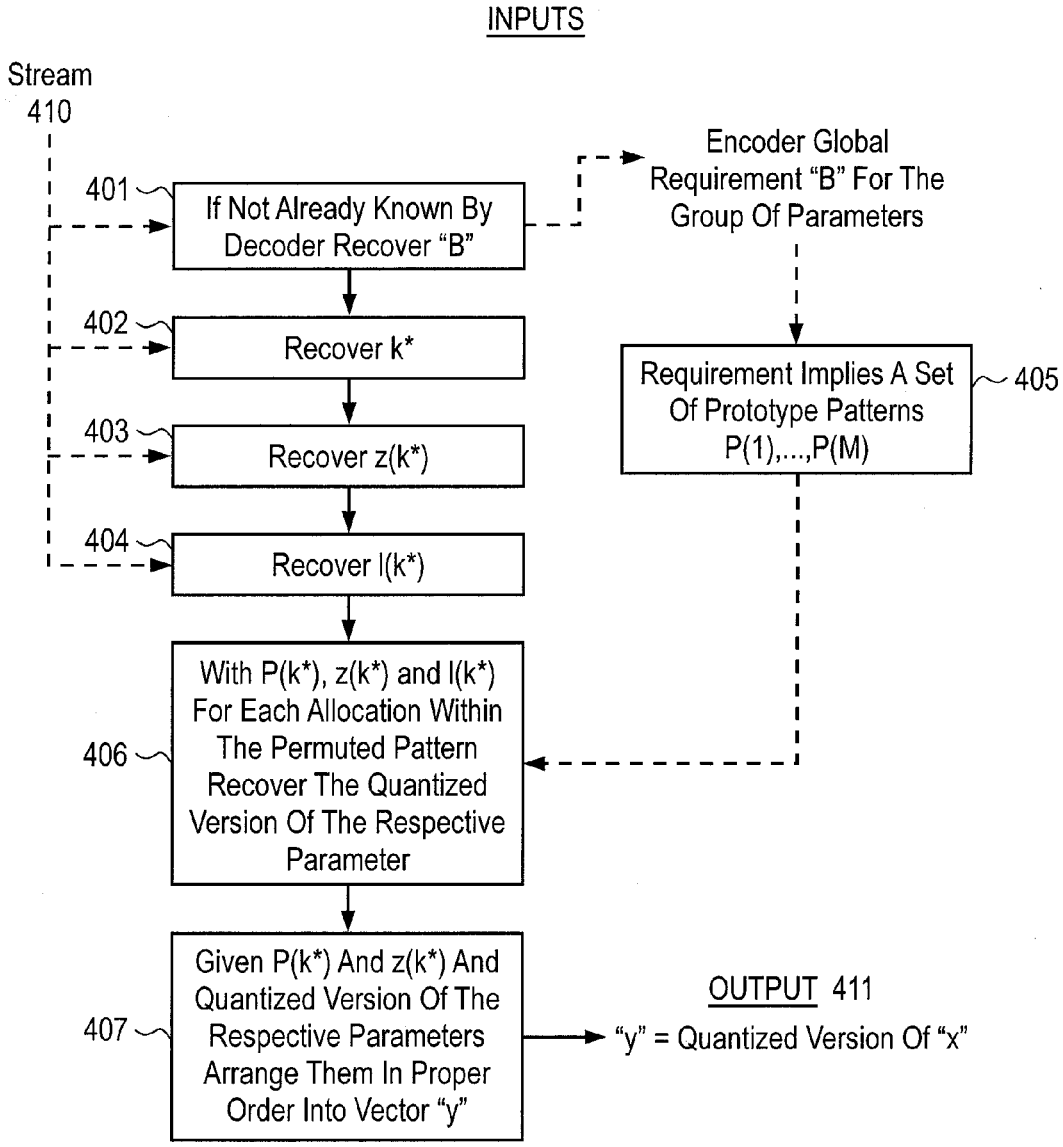
FIG. 4 is a flow diagram of another embodiment of a decoding process.

FIG. 4 is a flow diagram of another embodiment of a decoding process. The process is performed by processing logic that may comprise hardware (circuitry, dedicated logic, etc.), software (such as is run on a general purpose computer system or a dedicated machine), or a combination of both. The processing logic may be part of a decoder.

Referring to FIG. 4, processing logic in the decoder receives stream 410 and decodes stream 410 to obtain B (processing block 401), k* (processing block 402), z(k*) (processing block 403), and I(k*) (processing block 404). As discussed above, B is the encoder's global requirement for the group of parameters, and this requirement implies a set of prototype patterns P(1), . . . , P(M) (405).

After recovering B, k*,z(k*), and I(k*), processing logic uses P(k*), z(k*), and I(k*) for each allocation within the permuted pattern to recover the quantized version of the respective parameter (processing block 406).

Then, given P(k*) and z(k*) and the quantized version of the respective parameters, processing logic arranges them in proper order into y (411), which is the quantized version of "x".

There are other more general variations to the embodiments described above. For example, instead of choosing just a single permutation for each prototype pattern in (B), one could in fact select a small number. This is shown in FIG. 5.

Figure 5:
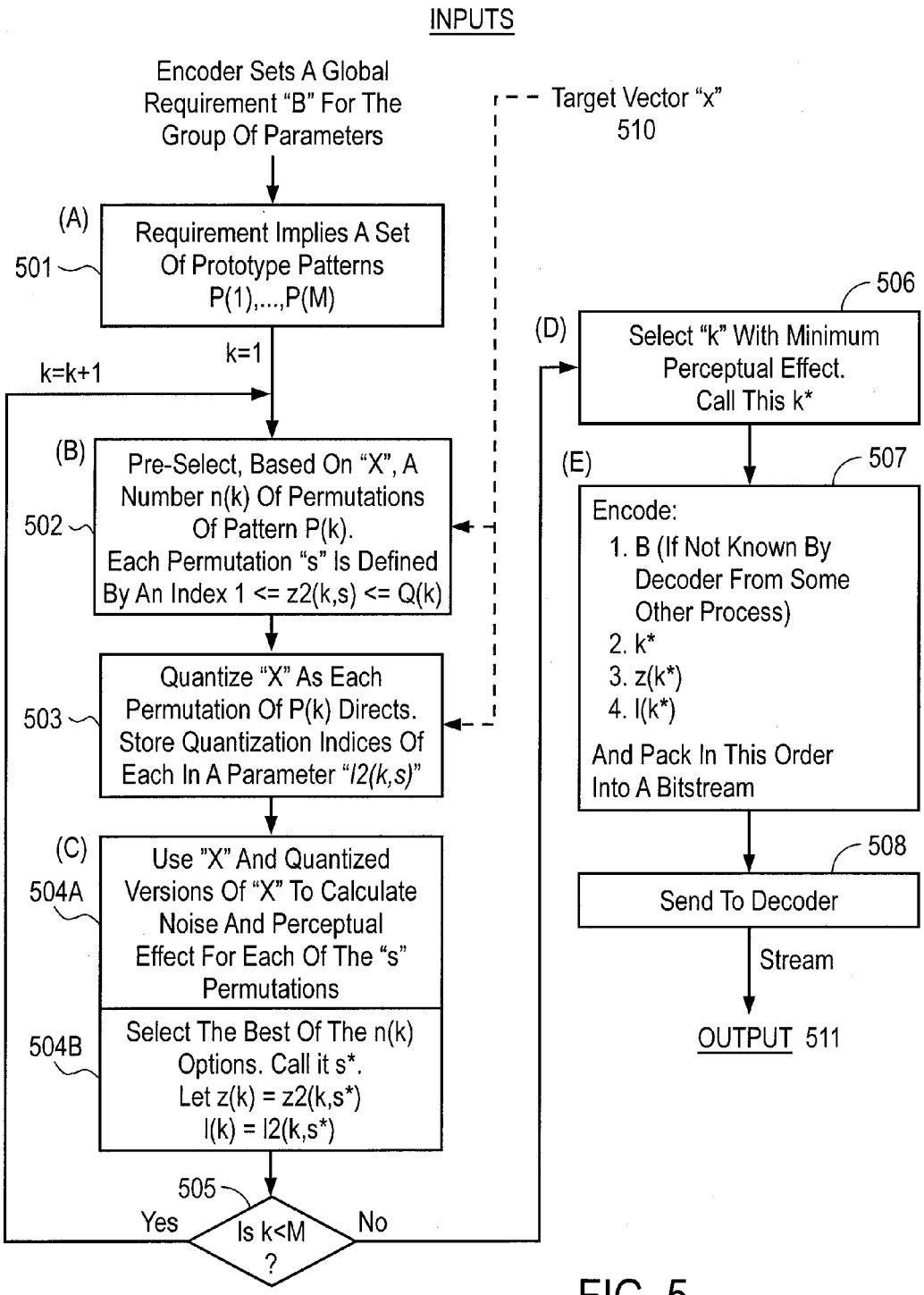
FIG. 5 is a flow diagram of another embodiment of an encoding process.

FIG. 5 is a flow diagram of another embodiment of an encoding process. The process is performed by processing logic that may comprise hardware (circuitry, dedicated logic, etc.), software (such as is run on a general purpose computer system or a dedicated machine), or a combination of both. The processing logic may be part of an encoder.

Referring to FIG. 5, prior to the encoding process beginning, the encoder sets a global requirement B for the group of parameters. This global requirement implies a set of prototype patterns P(1), . . . , P(M) (processing block 501).

With the global requirement for B set, processing logic initializes a variable k to 1 and the process begins with processing logic pre-selecting, based on X, a number n(k) of permutations of pattern P(k) (processing block 502). In one embodiment, each permutation s is defined by an index 1<=z2(k,s)<=Q(k).

Processing logic then quantizes X as the permutation of P(k) directs (processing block 503). In one embodiment, processing logic also stores the quantization indices in a parameter I2(k,s).

Processing logic uses X and the quantized version of X to calculate noise and perceptual effects for each of the s permutations (processing block 504A) and selects the best of the n(k) options (processing block 504B). For purposes herein, this selection is referred to as s*. Processing logic also sets z(k)=z2(k,s) and I(k)=I2(k,s).

Thereafter, processing logic tests whether k<M, the number of patterns (processing block 505). If it is, processing logic increments k by one and transitions to processing block 502 where the process continues and repeats. If not, processing logic transitions to processing block 506.

At processing block 506, processing logic selects the k with the minimum perceptual effect. As above, for purposes herein, this is referred to as k*.

Once k* has been selected, processing logic encodes B (if not known by the decoder from some other process), k*, index z(k*) that defines the permutation, and the parameter I(k*) that stores the quantization indices and packs them in this order into a bitstream (processing block 507), although other orders may be used as long as the decoder is aware of the order.

Once packed into the bitstream, processing logic sends the bitstream as output 511 (processing block 508). In one embodiment, the bitstream is sent to memory. In another embodiment, the bitstream is sent to a decoder for subsequent decoding.

A FIRST PREFERRED EMBODIMENT

In one preferred embodiment, the following features may be used in both FIGS. 3 and 5. For the prototype patterns, in the first preferred embodiment, the prototype patterns are bit-allocation patterns. That is, each of the values p(j) or p(i,j) of prototype patterns specify exactly how many bits are used to specify the index of the quantized parameter coding as directed by that value.

Also in the first preferred embodiment, the selection of the best permutation of a prototype pattern for a target X is calculated by using a permutation that assigns (in a loose fashion or exactly) more bits in general to values x(j) of higher energy. This follows the general principle mentioned above that states that such components tend to be more perceptually relevant and, that by coding them with greater fidelity, their effectiveness in masking noise introduced (by quantization) into other components is increased.

In one embodiment, this can be implemented by first making sure that prototype patterns are arranged in descending order of bit allocation values, i.e. if a prototype pattern P(k)=[a,b,c,d,e, . . . ], the goal is to have a≧b≧c≧d≧e≧ . . . . The pattern is not permuted, but rather the vector X is such that $$x(1),x(2), \ldots ,x(N) \rightarrow x(i(1)),x(i(2)), \ldots ,x(i(N))$$

were roughly x(i(1)),x(i(2)), . . . ,x(i(N)) is in order of descending energy. An example of a "rough" order of interest would be that only the first m<N are correctly ordered. Another example involves cases where there are repeated values in P(k) and the relative order of the corresponding "x(i(j))" values for the same p(j,k) values does not matter. A permutation is selected and applied to X at the encoder for each prototype pattern, quantization with the prototype pattern (and its permutation) is tested, the "best" permutation is selected and information uniquely specifying the choice is sent to the decoder. At the decoder, the quantized version is first recovered in un-permuted form as directed by the un-permuted selected proto-type. This is inv-permuted given the information on the permutation selected at the encoder for this proto-type pattern.

Note, in the case P(k)=(p(1,k), p(2,k), . . . , p(i,N)) is a bit-assignment pattern, then testing the assignment p(i,k) to a parameter involves testing no more than $2^{p(i,k)}$ alternatives. For example, if a classic scalar or vector quantizer is used with no structure, the codebook would contain $2^{p(i,k)}$ alternatives represented by $2^{p(i,k)}$ codewords. The quantization process selects one of these alternatives, often the one giving the minimal quantization noise. Therefore, testing a pattern P(k), given the permutation required from the $2^{c(k)}$ alternatives (where $2^{c(k)}$ is often less than N!) is easily determined, involves a search with no more than $2^{p(1,k)}+2^{p(2,k)}+ \ldots + 2^{p(N,k)}$ alternatives. This is similar in complexity to a "Product Code" design in a VQ, but with additional perceptual considerations whereby a pre-selected permutation is selected in a perceptually relevant manner from the $2^{c(k)}$ alternatives. For example, if the Product Code had no perceptually relevant structure one would require testing up to $2^{c(k)} \times (2^{p(1,k)}+ 2^{p(2,k)}+ \ldots +2^{p(N,k)})$ alternatives.

Once the noise for each pattern "P(k)" is known, given the selected permutation for each pattern, the determination of the final joint selection of permutation and pattern, and thus quantization is a test over the "m" alternatives, one (m=M) or more (m>M) for each pattern, using a complex perceptual criteria. In this case, m is much less than $2^b$, and much less than the number of alternatives a classic design such as ACELP or many vector quantizers need to consider.

In the first preferred embodiment, in calculating the perceptual distortion for a given quantization option, the vector X is assumed to consist of frequency domain coefficients that are contiguous in frequency (e.g., as in a scale factor band). The following are also assumed: the target vector X=x(1),x(2), . . . ,x(N); a quantized value for a given option (proto-type pattern and permutation) is given by Y=y(1),y(2), . . . ,y(N); the error energy pattern for such an option is E=e(1), e(2), . . . ,e(N) where $e(j)=(x(j)-y(j))^2$; a absolute perceptual masking level pattern M(X,Y)=m(1),m(2), . . . , m(N) is selected for the target X, often defined by X but possibly also by Y in a manner similar to or exactly the same as in the determination of an "absolute perceptual threshold"; a weighting function W=w(1),w(2), . . . ,w(N) may also be selected; an absolute hearing threshold (in terms of energy) independent of the signal for each component T=t(1), t(2), . . . ,t(N) is selected; and a power law "q" is used.

In one embodiment, the perceptual distortion function "D(X,Y)" used in evaluating the quantized value Y with respect to X takes a form similar to that mentioned in U.S. Patent Application No. 60/837,164, entitled "A Method for Quantizing Speech and Audio Through an Efficient Perceptually Relevant Search of Multiple Quantization Patterns," filed on Aug. 11, 2006, equation (13) using these values of $$D(X, Y) = \sum_{j=1}^{N} w(j) \left( \frac{\max(0, e(j) - \max(m(j), t(j)))}{\left(1 - \left(\frac{x(j) * x(j)}{e(j)}\right)^2\right)} \right)^q$$

Such a distortion function has a complexity such that its use in traditional exhaustive searches may be impractical. This is due to the power q, the division operations in the ratio, and the calculation of M(X,Y), especially if M(X,Y) strongly depends on Y and thus needs to adapt to each option.

Furthermore, more accurately and more complex, though still very much of practical interest in the invention, is the case where spreading is applied to parameters in the distortion function. Here a spreading function B=b(−L1), b(−L1+1), . . . , b(0), b(1), . . . , b(L2+1) considers how energy may be spread over the Scala Media in a human's inner ear. The Scala Media is the structure which contains our "hair" (nerve) cells that respond to different frequency ranges. The range for different cells overlaps. In this case, to represent the spreading, one uses values e2(k) and x2(k) instead of e(k) and x(k) in the function above where E2=e2(1),e2(2), . . . ,e2(N)=conv(E,B), "and X2=x2(1),x2(2), . . . ,x2(N)=conv(Y,B). The operation conv( ) is the classic convolution operation known to those skilled in the art of signal processing. Implementation of this operation generally requires values e(k) and x(k)

for k<1 and k>N. This additional, and more accurate assessment via, convolution operations makes exhaustive searches even more impractical with classic quantization techniques.

More generally, one can use any positive function L( ) that maps the noise energy above masking to a perceptual loudness measure, as in D2( ) below. Here again "e" may be replace by "e2".

$$D2(X, Y) = \sum_{j=1}^{N} L(X, \max(0, e(j) - \max(m(j), t(j))))$$

Such loudness measures often take the form of power-law like functions, as in "D(X,Y)", where "q" can range from about ⅓ to ½. The loudness measure can also have an adaptive power law, e.g.

$$L(s)=W(s)\times s^{q(s)}$$

where W( ) is a energy dependent scaling and q( ) is a energy dependent exponent. It is known that energy to perceptual loudness mappings follow different power laws (exponents) depending on the signal energy, generally with larger power laws for low levels (faster increase in loudness with increase in energy) and smaller power laws for higher signal levels.

Alternatives with Respect to the First Preferred Embodiment

A number of alternatives that may be incorporated into the first preferred embodiment described above. The following alternatives can be taken together, separately, or in any combination to further refine the first preferred embodiment.

In one embodiment, the perceptual relevance that sorts parameters, and thus determines the permutation can be refined. As mentioned, the perceptual relevance of a parameter such as an MDCT coefficient is often related to its energy. Signal parameters with higher energy should be given a "p(i, k)" value that is no less than (it can be equivalent or larger) than a signal parameter with lower energy. In one embodiment, this process includes a is more complex refinement that states that the perceptual relevance is related to the ratio of the energy to a perceptual threshold such as, for example, the absolute perceptual threshold. Further refinements can be considered by applying various frequency dependent weightings and power-laws to the result.

In one embodiment, the value of the masking threshold M(X,Y) is the signal adaptive absolute perceptual threshold.

In one embodiment, the value of the masking threshold M(X,Y) is a scaled version of the signal energy.

In one embodiment, the prototype bit-patterns are such that the stream produced by the encoder and sent to the decoder for X is a pre-determined (fixed value for all patterns) number of bits. For example, it can be B bits where B is the number of bits assigned to X. In one embodiment, the stream consists of information to specify (possibly) B, k*, z(k*) and I(k*). In one embodiment, k* is specified with a fixed number of bits. In this case, it means that for all patterns $$\sum_{i=1}^{N} f(k, i) = B - \text{bits to specify } k^* \text{ and } z(k^*)$$

For example, for B=10, there are 4 possible prototype patterns (which means it takes 2 bits to specify k*), where each prototype pattern has 8 allowable permutations (which means it takes 3 bits to specify z(k*) regardless of k*), and each pattern is a sequence of positive integers (representing bit allocations) that sum to 10−3−2=5 bits.

In one embodiment, the prototype bit-patterns have very specific properties that lead to different perceptual effects for different signals. For example, given N, patterns may implicitly represent concentration of (most or) all of the allowable bit counts in a few indices (e.g. in 1, 2, up to "m"<N indices). As an example, for 9 bits with N=4, the prototype patterns could be:

For concentration to one index, an example proto-type pattern: [9, 0, 0, 0]

For concentration to two indices, and example proto-type pattern: [5, 4, 0, 0]

For concentration to three indices, an example proto-type pattern: [3, 3, 3, 0].

In one embodiment, when multiple prototype patterns are used, one prototype pattern is selected and represents an equal (or as equal as possible) allocation of the available bits, i.e. a pattern P(k) where f(ilk)≈f(j,k) for all i,j. In the example above, with N=4 and 9 bits, such a pattern would be [2, 2, 2, 3]. There are 4 unique permutations of such a pattern.

Often prototype patterns have repeated values, as in the examples above where numbers like "0", "3", "2" are repeated. This has the resulting property that there are less than N! unique permutations for each pattern. For example, for [2, 2, 2, 3], there are 4 unique permutations of such a pattern. Specifying a unique permutation would require 2 bits of information.

In one embodiment, the bit-allocations are permuted, and not the vector X, in selecting the best pattern.

All of the perceptual measures described above in conjunction with the first preferred constitute additive models of distortion in which the distortion of all components together is the sum of the distortion from individual components. This is not a perfect representation of true human perception. Therefore, in other embodiments, more advanced forms of distortion functions that consider more carefully how multiple noise components are perceived together are used. Examples of these distortion functions as described in L. E. Humes, et al., "Models of the additivity of masking", Journal of the Acoustical Soc. of America, number 3, volume 85, pp 1285-1294 March 1989 and Harvey Fletcher, "The ASA Edition of Speech and Hearing in Communication," edited by Jont B. Allen, Published for The Acoustical Society of America by the American Institute of Physics, 1995. One example for scale-factor bands whose width is smaller than a critical band of hearing one may not (or should not) consider each component in X as an individual component. Rather, the total energy and total masking is considered as a unit. After all, the human ear cannot differentiate such components given their close proximity in frequency. In such a case, the following revision of D(X,Y) could be useful:

$$D4(X, Y) = \left( \frac{\max\left(0, \left[\sum_{j=1}^{N} e(j)\right] - \max(Mt, T)\right)}{\left(1 - \left(\frac{\sum_{i=1}^{N} x(j) * x(j)}{\sum_{j=1}^{N} e(j)}\right)^2\right)} \right)$$

This would be an example where the spreading function "B" is applied not as a convolution, but as simply an inner-product with b(k)=1 for all k. Above, Mt and T are common masking and hearing thresholds (e.g., the "Absolute Perceptual Thresholds" described above) for the entire scale-factor band.

A SECOND PREFERRED EMBODIMENT

In a second preferred embodiment, the following features may be used in both FIGS. 3 and 5. For the prototype patterns, in the second preferred embodiment, the prototype patterns are more generally quantization patterns. For example, in one embodiment, for scalar quantization, the pattern is a pattern of quantization step sizes. This would then be a pattern of possibly unequal step sizes $[\Delta(1), \Delta(2), \Delta(3), \ldots, \Delta(N)]$ This would be different from the process in FIG. 1A which essentially would be a uniform pattern, such as $[\Delta, \Delta, \Delta, \ldots, \Delta]$ In another embodiment, the quantization patterns include a pattern of any parameters that direct the characteristics of the quantizer used. Some characteristics of interest, besides the codebook size (i.e. number of bits) and step-size mentioned already, include one or a combination of: the dynamic range covered by the quantization option; the dimension of the quantizer; and the maximum bits that a quantization index would generate after applying a variable length code (e.g., a Huffman code) to the quantization index. In the case of the dimension of the quantizer, in one embodiment, there is a pattern $[d(1), d(2), \ldots, d(h)]$ where $d(1)+d(2)+\ldots+d(h)=N$, i.e. there would be enough "dimensions" to cover the entire "N" dimensional target X.

In the second preferred embodiment, the selection of the best permutation of a prototype pattern for a target X is in a similar spirit of that in the first preferred embodiment. In general, a quantization option that would quantize a higher energy component with higher fidelity is assigned to higher energy components. As in the first preferred embodiment, one can implement this by first ordering the proto-type pattern and then partially (or fully) re-ordering X based on energy.

In the second preferred embodiment, the perceptual distortion is calculated in the same manner as the first preferred embodiment.

Alternatives with Respect to the Second Preferred Embodiment

The following refinements to the second preferred embodiment can be taken together, separately, or in any combination with the features described above.

When multiple prototype patterns are used, each prototype patterns conform (roughly) to some global criteria. For example, in the case of step size patterns for scalar quantizers with a prototype pattern $P(k)=[\Delta(1,k), \Delta(2,k), \Delta(3,k), \ldots, \Delta(N,k)]$ some such criteria could be $$\sum_{j=1}^{N} \Delta(j,k)^2 \approx C$$

where C is some common upper bound on the total noise energy an option could introduce.

In one embodiment, the prototype bit-patterns have very specific properties. More specifically, given N, patterns may implicitly represent concentration of most of the quantization resources in a few indices, e.g. in 1, 2, up to m<N indices. For example, analogous to the first preferred embodiment, a pattern may have a few small Δ's.

In one embodiment, when multiple prototype patterns are used, one prototype pattern may represent an equal (or as equal as possible) allocation of the quantization resources.

In another embodiment, prototype patterns often have repeated values.

In another embodiment, the quantization patterns are permuted, and not the vector X, in selecting the best pattern.

Further Examples of Encoding and Decoding Systems

Figure 6:
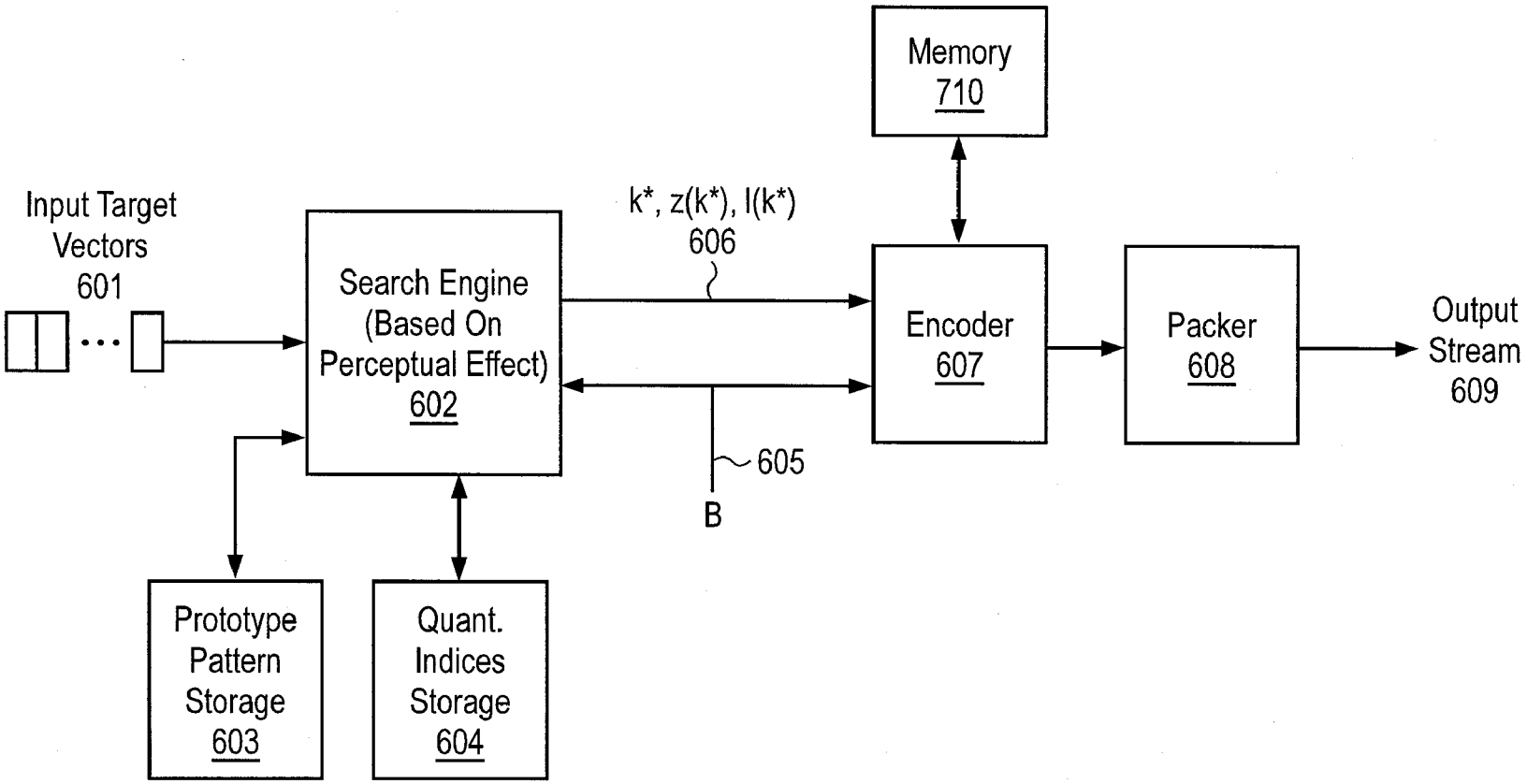
FIG. 6 is a block diagram of one embodiment of an encoding system.

FIG. 6 is a block diagram of one embodiment of an encoding system. Referring to FIG. 6, each of the blocks may be implemented in hardware (circuitry, dedicated logic, etc.), software (such as is run on a general purpose computer system or a dedicated machine), or a combination of both.

Referring to FIG. 6, input target vectors 601 are received by search engine 602. Based on input of a global parameter B (605), search engine 602 performs a search to select a one of a group of permutations of prototype patterns P(1), . . . ,P(M), which are stored in storage (e.g., memory) 603. In one embodiment, the search performed is the same as described in conjunction with FIG. 3. In another embodiment, the search performed is the same as described in conjunction with FIG. 5.

As a result of the search, search engine 602 outputs k*, z(k*), and I(k*) (606) to encoder 607. Encoder 607 encodes k*, z(k*), and I(k*) (606) and optionally encodes B (if not known by the decoder) to produce encoded data. Packer 608 packs the encoded data into a bit stream that is output as output stream 609. In one embodiment, the packing operation performed by packer 608 is performed by encoder 607.

Figure 7:
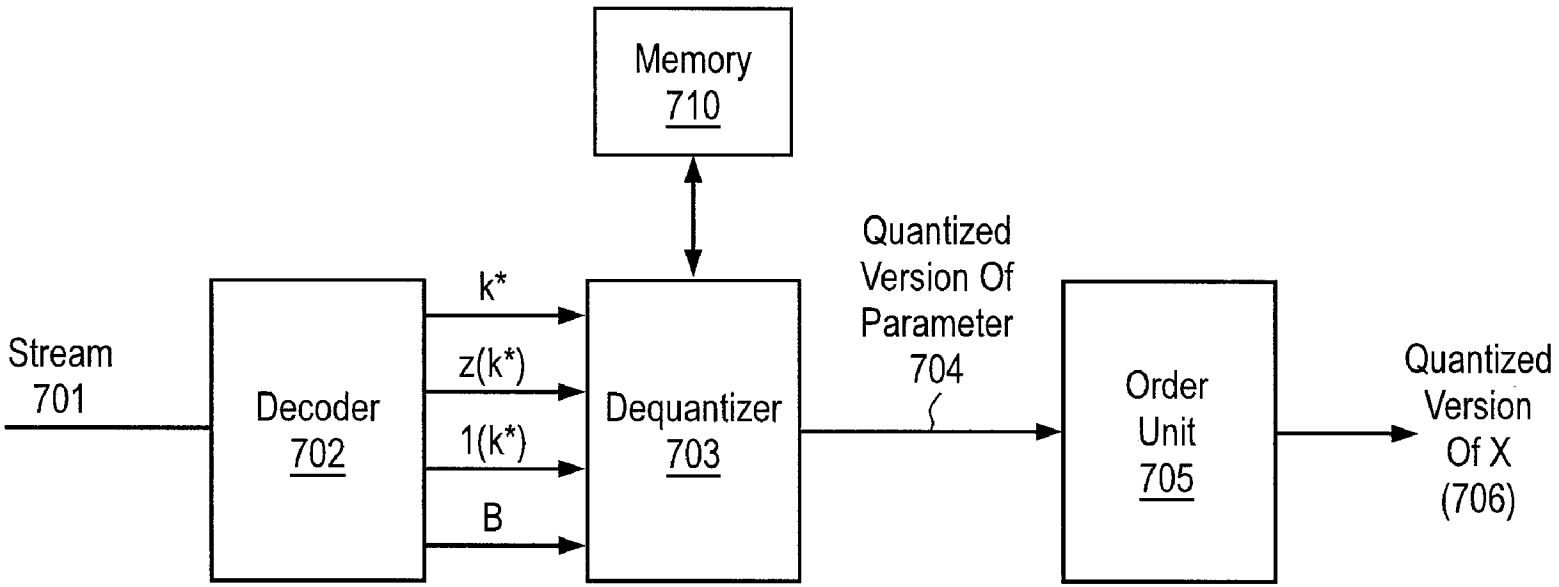
FIG. 7 is a block diagram of one embodiment of a decoding system.

FIG. 7 is a block diagram of one embodiment of a decoding system. Referring to FIG. 7, each of the blocks may be implemented in hardware (circuitry, dedicated logic, etc.), software (such as is run on a general purpose computer system or a dedicated machine), or a combination of both.

Referring to FIG. 7, decoder 702 receives bitstream 701 and recovers k*, z(k*), and I(k*) and, optionally, B for each vector to be dequantized. Dequantizer 703 receives these outputs for each allocation within the permuted pattern, recovers the quantized version of the respective parameter 704, and outputs the quantized version of the respective parameter 704 to order unit 705. Based on the prototype pattern for k* and the permutation defined by the index z(k*), order unit 705 arranges the quantized version of the respective parameter 704 in proper order.

An Example of a Computer System

Figure 8:
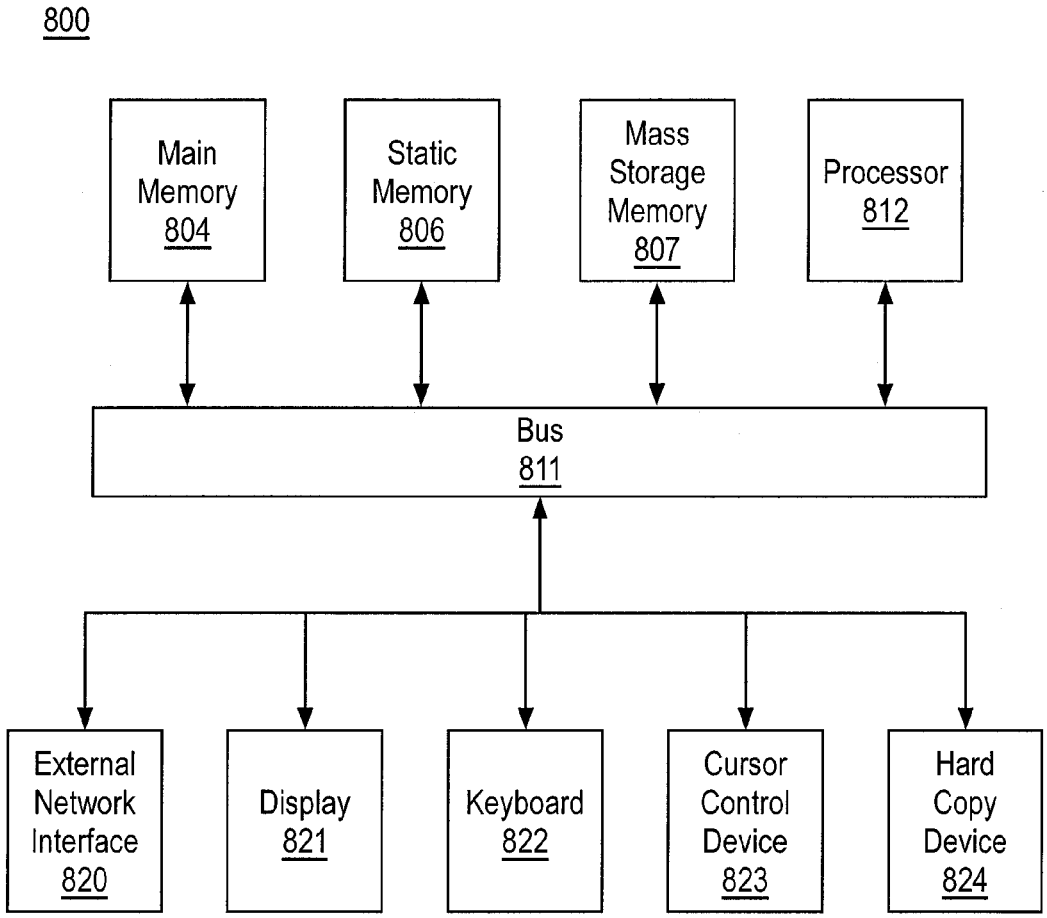
FIG. 8 is a block diagram of an exemplary computer system

FIG. 8 is a block diagram of an exemplary computer system that may perform one or more of the operations described herein. Referring to FIG. 8, computer system 800 may comprise an exemplary client or server computer system. Computer system 800 comprises a communication mechanism or bus 811 for communicating information, and a processor 812 coupled with bus 811 for processing information. Processor 812 includes a microprocessor, but is not limited to a microprocessor, such as, for example, Pentium™, PowerPC™, Alpha™, etc.

System 800 further comprises a random access memory (RAM), or other dynamic storage device 804 (referred to as main memory) coupled to bus 811 for storing information and instructions to be executed by processor 812. Main memory 804 also may be used for storing temporary variables or other intermediate information during execution of instructions by processor 812.

Computer system 800 also comprises a read only memory (ROM) and/or other static storage device 806 coupled to bus 811 for storing static information and instructions for processor 812, and a data storage device 807, such as a magnetic disk or optical disk and its corresponding disk drive. Data storage device 807 is coupled to bus 811 for storing information and instructions.

Computer system 800 may further be coupled to a display device 821, such as a cathode ray tube (CRT) or liquid crystal display (LCD), coupled to bus 811 for displaying information to a computer user. An alphanumeric input device 822, including alphanumeric and other keys, may also be coupled to bus 811 for communicating information and command selections to processor 812. An additional user input device is cursor control 823, such as a mouse, trackball, trackpad, stylus, or cursor direction keys, coupled to bus 811 for communicating direction information and command selections to processor 812, and for controlling cursor movement on display 821.

Another device that may be coupled to bus 811 is hard copy device 824, which may be used for marking information on a medium such as paper, film, or similar types of media. Another device that may be coupled to bus 811 is a wired/wireless communication capability 825 to communication to a phone or handheld palm device.

Note that any or all of the components of system 800 and associated hardware may be used in the present invention. However, it can be appreciated that other configurations of the computer system may include some or all of the devices.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

I claim:

1. A method for quantizing a target vector comprising:

performing a perceptually relevant search of multiple quantization patterns in which one of a plurality of prototype patterns and its associated permutation are selected to quantize the target vector, each prototype pattern in the plurality of prototype patterns being capable of directing quantization across the vector;

converting the one prototype pattern, the associated permutation and quantization information resulting from both to a plurality of bits by an encoder; and transferring the bits as part of a bit stream.

2. The method defined in claim 1 wherein performing the perceptually relevant search of multiple quantization patterns comprises selecting a plurality of permutations of the plurality of prototype patterns; and selecting one of the plurality of prototype patterns and its associated permutation by searching the selected permutations using a distortion criterion.

3. The method defined in claim 2 wherein selecting the plurality of permutations of a plurality of prototype patterns is performed in an open loop manner.

4. The method defined in claim 2 wherein selecting the plurality of permutations of the plurality of prototype patterns is performed implicitly by re-ordering elements of the target vector into an ordering without reordering elements in each prototype pattern.

5. The method defined in claim 4 wherein the elements of the target vector are re-ordered based on energy into an ordering that is selected from a group consisting of a complete ordering and a loose ordering.

6. The method defined in claim 5 wherein the ordering is a partial ordering.

7. The method defined in claim 4 wherein the elements of the target vector are re-ordered based on perceptual relevance into an ordering that is selected from a group consisting of a complete ordering and a loose ordering.

8. The method defined in claim 7 wherein the ordering is a partial ordering.

9. The method defined in claim 1 wherein the one prototype pattern specifies a number of bits to be allocated to each element in the target vector during quantization.

10. The method defined in claim 1 wherein the one prototype pattern defines quantization step sizes to be allocated to each element in a vector during quantization.

11. The method defined in claim 1 wherein the one prototype pattern specifies a local dimension of a quantizer to perform the quantization.

12. The method defined in claim 11 wherein the local dimension indicates a number of elements in the target vector to be jointly quantized.

13. The method defined in claim 1 wherein each of the plurality of prototype quantization patterns has repeated elements that define equivalent quantization options.

14. The method defined in claim 1 wherein transferring the bits as part of a bit stream comprises transferring the bit stream to a decoder.

15. The method defined in claim 1 wherein transferring the bits as part of a bit stream comprises storing the bit stream in a memory.

16. An apparatus comprising:

a selector to perform a search of multiple quantization patterns and select, based on perceptually relevance, one of a plurality of prototype patterns and its associated permutation to quantize a target vector, each prototype pattern in the plurality of prototype patterns being capable of directing quantization across the vector; and an encoder to convert the one prototype pattern, the associated permutation and quantization information resulting from both to a plurality of bits and to transfer the bits as part of a bit stream.

17. The apparatus defined in claim 16 wherein the selector selects a plurality of permutations of the plurality of prototype patterns and then selects one of the plurality of prototype patterns and its associated permutation by searching the selected permutations using a distortion criterion.

18. The apparatus defined in claim 17 wherein the selector selects the plurality of permutations of the plurality of prototype patterns implicitly by re-ordering elements of the target vector.

19. The apparatus defined in claim 16 wherein the one prototype pattern specifies one of a group consisting of a number of bits to be allocated to each element in the target vector during quantization, quantization step sizes to be allocated to each element in a vector during quantization, and a local dimension of a quantizer to perform the quantization.

20. An article of manufacture having one or more non-transitory computer readable media storing instructions thereon which, when executed by a system, cause the system to perform a method comprising:

performing a perceptually relevant search of multiple quantization patterns in which one of a plurality of prototype patterns and its associated permutation are selected to quantize the target vector, each prototype pattern in the plurality of prototype patterns being capable of directing quantization across the vector;

converting the one prototype pattern, the associated permutation and quantization information resulting from both to a plurality of bits by an encoder; and transferring the bits as part of a bit stream.

21. The article of manufacture defined in claim 20 wherein performing the perceptually relevant search of multiple quantization patterns comprises selecting a plurality of permutations of the plurality of prototype patterns; and selecting one of the plurality of prototype patterns and its associated permutation by searching the selected permutations using a distortion criterion.

22. A method for decompressing a bit stream comprising:

receiving the bit stream;

decoding bits in the bit stream;

recovering a quantized version of a parameter using a quantization pattern, a permutation and a quantization index identified by the decoded bits;

creating a quantized version of the target vector by reordering the quantization pattern and the permutation.

* * * * *